US006220696B1

(12) United States Patent
Suetsugu et al.

(10) Patent No.: US 6,220,696 B1
(45) **Date of Patent: *Apr. 24, 2001**

(54) SIMPLE ELECTROSTATIC INK JET PRINTING HEAD HAVING LOW COST

(75) Inventors: Junichi Suetsugu; Kazuo Shima; Yoshihiro Hagiwara; Ryosuke Uematsu; Hitoshi Minemoto; Toru Yakushiji; Tadashi Mizoguchi; Hitoshi Takemoto, all of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/789,132

(22) Filed: Jan. 28, 1997

(30) Foreign Application Priority Data

Jan. 29, 1996 (JP) ..... 8-012897
Jan. 29, 1996 (JP) ..... 8-012902

(51) Int. Cl.[7] ..... B41J 2/06
(52) U.S. Cl. ..... 347/55
(58) Field of Search ..... 347/55, 44, 47

(56) References Cited

U.S. PATENT DOCUMENTS

| | | | | |
|---|---|---|---|---|
| 4,403,228 | * | 9/1983 | Miura et al. | 347/55 |
| 4,680,593 | | 7/1987 | Takeno et al. . | |
| 4,794,463 | | 12/1988 | Tamura et al. . | |
| 4,912,489 | * | 3/1990 | Schmidlin | 347/55 |
| 5,975,684 | * | 11/1999 | Suetsugu et al. | 347/55 |
| 5,988,793 | * | 11/1999 | Hattori | 347/55 |
| 6,074,044 | * | 6/2000 | sSuetsugu et al. | 347/55 |

FOREIGN PATENT DOCUMENTS

| | | | | |
|---|---|---|---|---|
| 0624472 | | 11/1994 | (EP) . | |
| 356058878 | * | 5/1981 | (JP) . | |
| 56-58878 | | 5/1981 | (JP) . | |
| 357027759 | * | 2/1982 | (JP) . | |
| 57-27759 | | 2/1982 | (JP) . | |
| 360228162 | * | 11/1985 | (JP) . | |
| 60-228162 | * | 11/1985 | (JP) . | |
| 361286150 | * | 12/1986 | (JP) . | |
| 61-286150 | | 12/1986 | (JP) . | |
| 62-227755 | * | 10/1987 | (JP) | 347/55 |
| 4-182151 | * | 6/1992 | (JP) . | |
| WO/93/11866 | * | 6/1993 | (WO) . | |
| WO9532864 | | 12/1995 | (WO) . | |

OTHER PUBLICATIONS

Admitted prior art from copending application Ser. No. 08/747,821, Figures 1 and 2, Nov. 1996.*

* cited by examiner

*Primary Examiner*—John Barlow
*Assistant Examiner*—Michael S. Brooke
(74) *Attorney, Agent, or Firm*—Sughrue, Mion, Zinn, Macpeak & Seas, PLLC

(57) ABSTRACT

An electrostatic ink jet printing head comprises printing electrodes formed on the base film of a substrate. The printing electrodes have insulating coating films which coat the printing electrodes, respectively. Each of the printing electrodes has a main electrode portion formed on the base film and a protruding electrode portion which protrudes from the base film. A covering member covers the main electrode portion. The covering member has an internal surface defining, in cooperation with the main electrode portions and the base film, a ink receiving space which receives ink containing toner particles.

34 Claims, 11 Drawing Sheets

SIMPLE ELECTROSTATIC INK JET PRINTING HEAD HAVING LOW COST

BACKGROUND OF THE INVENTION

This invention relates to an electrostatic ink jet printing head, and more particularly, to an electrostatic ink jet printing head which adheres toner particulates to a recording medium.

DESCRIPTION OF THE RELATED ART

A non-impact printing method has recently become interesting because the non-impact printing method makes negligable undesired sounds when printing. An ink jet printing method as the non-impact printing method can, in high speed, directly print to a sheet of plain paper by a simple mechanism. An electrostatic ink jet printing method is known as the ink jet printing method. The electrostatic ink jet printing method comprises printing electrodes and a counter electrode. When the printing electrodes are selectively supplied with printing pulse voltages, electric fields are caused between the printing electrodes and the counter electrode. A sheet of recording paper is positioned on the counter electrode. A small amount of coloring material such as ink is filed by electrostatic forces of the electric fields and adhered to the recording paper.

In the manner which will later be described in more detail, first, second, and third conventional electrostatic ink jet printing heads are known. The first conventional electrostatic ink jet printing head comprises a substrate and a covering member. The covering member has an internal surface defining, in cooperation with the substrate, an ink receiving space which receives ink containing coloring particulates. A plurality of printing electrodes are, in parallel, positioned in the ink receiving space. Front ends of the substrate and the covering member form an ink ejecting nozzle of a slit type. Each of the printing electrodes is formed in the shape of a needle. At a time of printing, the printing electrodes are selectively supplied with printing pulse voltages.

A counter electrode is positioned to counter the printing electrodes. A sheet of printing paper is positioned between the printing electrodes and the counter electrode so that the printing paper is in contact with the counter electrode. When the printing electrodes are supplied with printing pulse voltages, electric fields occur between the printing electrodes and the counter electrode. In this event, the electric field is concentrated at a front edge of the printing electrode. Thereby, electric charges in the ink are stored at a vicinity of the front edge of the printing electrode.

The second conventional electrostatic ink jet printing head is described in Japanese Unexamined Patent Prepublication (koukai) No. 228162/1985. The second conventional electrostatic ink jet printing head comprises a substrate, a covering member, printing electrodes, protruding portions, and reinforcement boards. The protruding portions are formed on the front end of the substrate so that the protruding portions correspond to front edges of the printing electrodes. The protruding portions give the ink meniscus preformed irregularities to concentrate the electric field at the vicinities of the front edges of the printing electrodes.

The third conventional electrostatic ink jet printing head comprises a substrate, a covering member, printing electrodes, and meniscus forming members. The meniscus forming members are positioned to correspond to the printing electrodes. The printing electrodes are formed by sputtering conductive material such as chromium to the whole surface of the substrate and by patterning the conductive material by photolithography. The meniscus forming members are formed by laminating a photosensitivity macromolecular film on the substrate and by patterning the photosensitivity macromolecular film by photolithography.

However, since the above conventional electrostatic ink jet printing heads comprise printing electrodes which are formed by sputtering conductive material such as chromium to the whole surface of the substrate and by patterning the conductive material by photolithography, and since the above conventional electrostatic ink jet printing heads comprise meniscus forming members that are formed by laminating a photosensitivity macromolecular film on the substrate and by patterning the photosensitivity macromolecular film by photolithography, the above conventional electrostatic ink jet printing heads have a complex manufacturing process and a high cost. In addition, since, in the above conventional electrostatic ink jet printing heads, the meniscus forming members are made of the photosensitivity macromolecular film, the thickness of the meniscus forming members is limited by a thickness of the photosensitivity macromolecular film. As a result, in the above conventional electrostatic ink jet printing heads, only a limited amount of ink can be ejected.

Referring to FIGS. 1, 2, 3, 4, and 5, first, second, and third conventional electrostatic ink jet printing heads will be described in order to gain a better understanding of this invention.

In FIG. 1, the first conventional electrostatic ink jet printing head comprises a substrate or base board 1 and a covering member 2. The covering member 2 has an internal surface defining, in cooperation with the substrate 1, an ink receiving space 3 which receives ink containing coloring particles. A plurality of printing electrodes 4 are, in parallel, positioned in the ink receiving space 3. Front ends of the substrate 1 and the covering member 2 form an ink ejecting nozzle of a slit type. Each of the printing electrodes 4 is formed in a shape of a needle. At a time of printing, the printing electrodes are selectively supplied with printing pulse voltages.

On the other hand, a counter electrode 5 is positioned to counter the printing electrodes 4. A sheet of printing paper 6 is positioned between the printing electrodes 4 and the counter electrode 5 so that the printing paper 6 is in contact with the counter electrode 5. When the printing electrodes are supplied with printing pulse voltages, electric fields occur between the printing electrodes 4 and the counter electrode 5. In this event, the electric field is concentrated at a front edge of the printing electrode 4. Thereby, electric charges in the ink are stored at a vicinity of the front edge of the printing electrode 4.

Processes of storing the electric charges in the ink are different due to kinds of the ink used. In case of conductive ink, storing the electric charges is due to electrostatic induction. Also, in case of dielectric ink, storing the electric charges is due to polarization. In addition, in case of ink having colored particles which are dispersed in the ink, storing the electric charges is due to inherent charges of the coloring particles that are caused by zeta potential.

In any case, the ink or the coloring particles in the ink are, by Coulomb's force which acts the stored electric charges, strained in a direction of the counter electrode 5, namely, the printing paper 6. When Coulomb's force is stronger than surface tension of the ink, a small amount of the ink is flied to be adhered on the printing paper 6. In this case, the printing pulse voltages which are supplied to the printing electrodes are appropriately controlled in response to printing images.

However, since electric conductivity and dielectric constant of the ink for use in printing is greater than electric conductivity and dielectric constant of air, a location at which the electric charges are concentrated is not determined by only position of the printing electrode 4, but is also influenced by a state of an ink meniscus at the ink ejecting nozzle. Namely, although it is expected that the ink meniscus is homogeneous in a longitudinal direction of the ink ejecting nozzle, minute irregularities of the ink meniscus are really caused due to machining accuracies of the ink ejecting nozzle, due to vibrations the ink meniscus after ejecting the ink, and due to natural fluctuations of the ink meniscus.

In this case, the electric field is more concentrated at minute convex portions of the ink meniscus in the vicinity of the printing electrode 4 due to conductive or dielectric properties of the ink. When the ink meniscus once starts to deform by Coulomb's force, the electric field is more concentrated. As a result, since the minute irregularities of the ink meniscus are clearly present in an initial state, it is impossible to accurately control the location from which the ink flies. In other words, when one of the printing electrodes 4 is supplied with the printing pulse voltage, the ink flies from a location which does not correspond to the one of the printing electrodes 4. This causes deterioration of printing quality.

Shown in FIG. 2, for resolving the above disadvantage, the second conventional electrostatic ink jet printing head as described in Japanese Unexamined Patent Prepublication (koukai) No. 228162/1985. The second conventional electrostatic ink jet printing head comprises the substrate 1, the covering member 2, the printing electrodes 4, protruding portions 7, and reinforcement boards 8. The protruding portions 7 are formed on the front end of the substrate 1 so that the protruding portions 7 correspond to front edges of the printing electrodes 4. The protruding portions 7 give the ink meniscus preformed irregularities to concentrate the electric field at the vicinities of the front edges of the printing electrodes 4.

In FIGS. 3, 4, and 5, the third conventional electrostatic ink jet printing head comprises the substrate 1, the covering member 2, the printing electrodes 4, and meniscus forming members 9. The meniscus forming members 9 are positioned to correspond with the printing electrodes 4.

The printing electrodes 4 are formed by sputtering conductive material such as chromium to the whole surface of the substrate 1 and by patterning the conductive material by photolithography. The printing electrodes 4 are positioned with, for example, a space of 300 dpi (dots per inch), namely, about 85 micron meter left between two adjacent ones of the printing electrodes 4. The printing electrodes 4 are connected to a driver (not shown) and are selectively supplied with printing pulse voltages.

The meniscus forming members 9 are formed by laminating a photosensitivity macromolecular film on the substrate land by patterning the photosensitivity macromolecular film by photolithography. Each of the meniscus forming members 9 has a front end which is slightly retreated from the front edge of the printing electrode 4. The photosensitivity macromolecular film has a thickness of 30 micron meter. Each of the meniscus forming members 9 has a width of about 30 micron meter. The covering member 2 is attached on the meniscus forming members 9. The covering member 2 has a front end which is slightly retreated from the front end of the meniscus forming members 9. The covering member 2 is made of insulating material and has an ink supply port 10 and an ink exhaust port 11. Each of the meniscus forming members 9 has a front end which is slightly protruded from the ink ejecting nozzle.

However, since the above conventional electrostatic ink jet printing heads comprise the printing electrodes 4 which are formed by sputtering conductive material such as chromium to the whole surface of the substrate 1 and by patterning the conductive material by photolithography, and since the above conventional electrostatic ink jet printing heads comprise the meniscus forming members 9 are formed by laminating a photosensitivity macromolecular film on the substrate 1 and by patterning the photosensitivity macromolecular film by photolithography, the above conventional electrostatic ink jet printing heads have a complex manufacturing process and a high cost. In addition, since, in the above conventional electrostatic ink jet printing heads, the meniscus forming members 9 are made of the photosensitivity macromolecular film, a thickness of the meniscus forming members 9 are limited by a thickness of the photosensitivity macromolecular film. As a result, in the above conventional electrostatic ink jet printing heads, an amount of ink to be ejected is limited.

SUMMARY OF THE INVENTION

It is therefore an object of this invention to provide a electrostatic ink jet printing head which has a simple manufacturing process and a low cost.

It is another object of this invention to provide a electrostatic ink jet printing head in which the amount of ink to be ejected is not limited.

Other objects of this invention will become clear as the description proceeds.

According to the first aspect of this invention, there is provided an electrostatic ink jet printing head comprising:

a substrate made of electrically insulating material and having a principal surface:

a base film made of electrically insulating material and overlaying the principal surface;

a plurality of printing electrodes formed on the base film with a predetermined space left between two adjacent ones of the printing electrodes, the printing electrodes having electrically insulating coating films which coat surfaces of the printing electrodes, respectively, each of the printing electrodes having a main electrode portion formed on the base film and a protruding electrode portion which protrudes from the base film; and a covering member made of insulating material and covering the main electrode portion, the covering member having an internal surface defining, in cooperation with the main electrode portions and the base film, an ink receiving space which receives ink containing toner particles.

DESCRIPTION OF THE PREFERRED EMBODIMENTS

Figure 1:
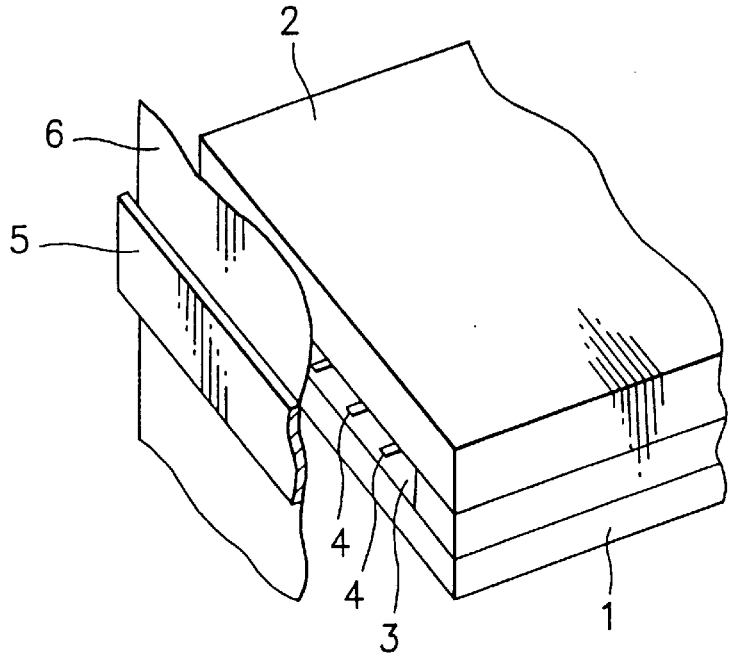
FIG. 1 PRIOR ART
FIG. 1 is a schematic perspective view of the first conventional electrostatic ink jet printing head.
Figure 2:
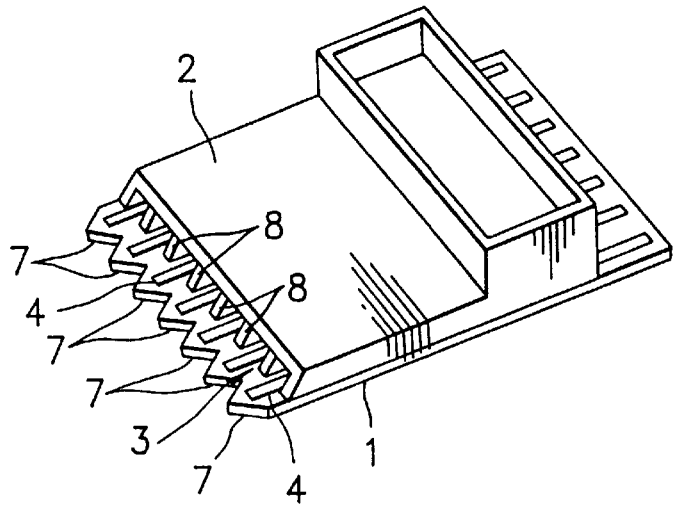
FIG. 2 PRIOR ART
FIG. 2 is a schematic perspective view of the second conventional electrostatic ink jet printing head.
Figure 3:
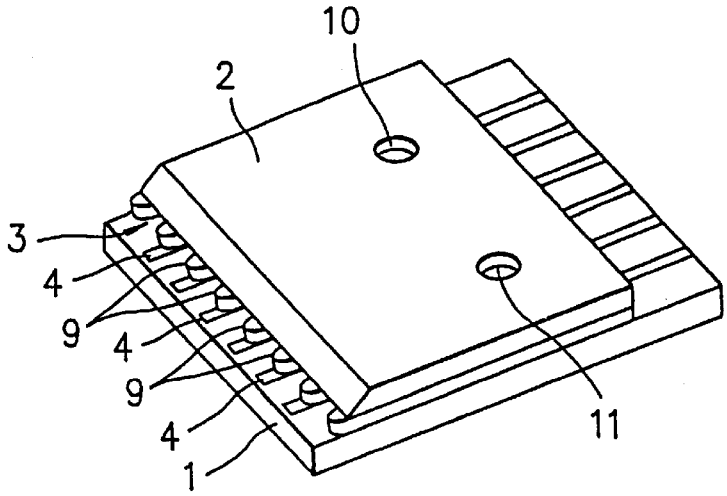
FIG. 3 PRIOR ART
FIG. 3 is a schematic perspective view of the third conventional electrostatic ink jet printing head.
Figure 4:
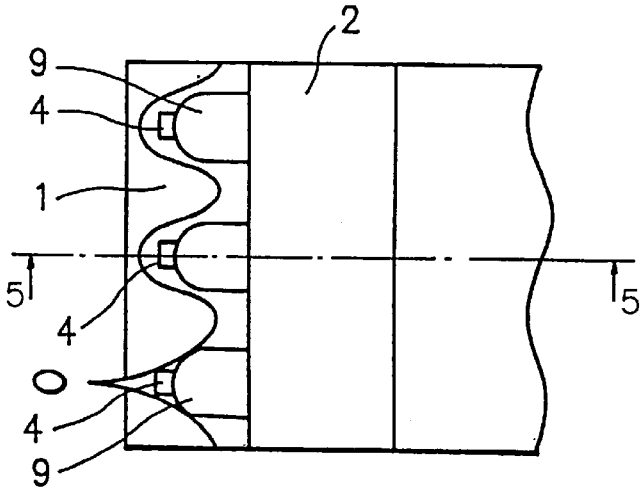
FIG. 4 PRIOR ART
FIG. 4 is a schematic plan view of the third conventional electrostatic ink jet printing head illustrated in FIG. 3.
Figure 5:
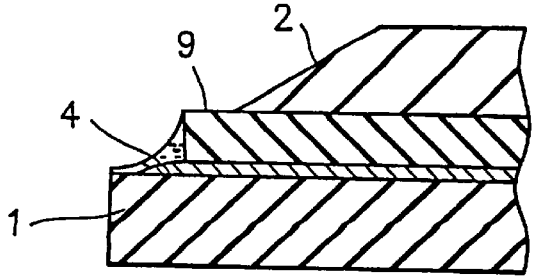
FIG. 5 PRIOR ART
FIG. 5 is a section view taken along a line A—A in FIG. 4.

Referring to FIGS. 6, 7, 8, and 9, the description will proceed to an electrostatic ink jet printing head according to a first embodiment of this invention. Similar parts are designated by like reference numerals.

Figure 6:
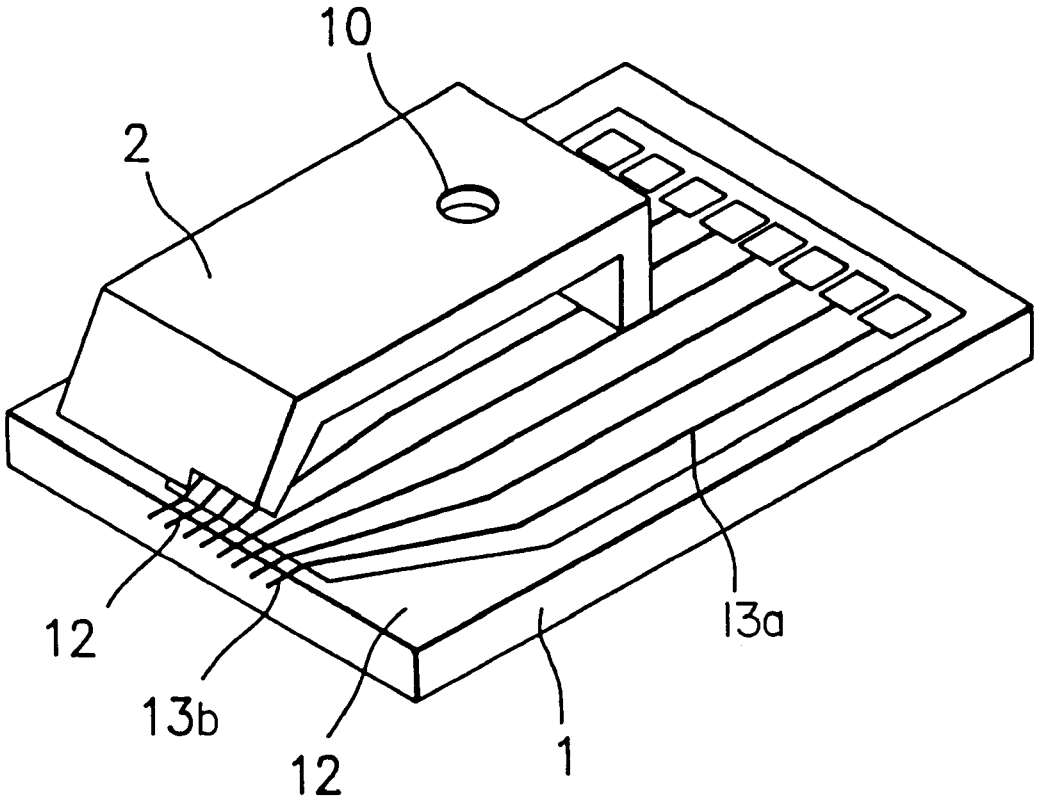
FIG. 6 is a schematic perspective view of an electrostatic ink jet printing head according to the first embodiment of this invention.

In FIG. 6, the electrostatic ink jet printing head comprises the substrate 1, a base film 12, the printing electrodes 13, and the covering member 2. The substrate 1 is made of insulating material such as plastic and has a principal surface. The base film 12 is made of insulating material such as polyimide and overlays the principal surface of the substrate. The base film 12 has a thickness of about 50 micron meter. The printing electrodes 13 are formed on the base film 12 with a predetermined space left between two adjacent ones of the printing electrodes 13 by pattern metal plating conductive material such as copper. Each of the printing electrodes 13 has a thickness of about 20 to 30 micron meter. The printing electrodes 13 are positioned with a space of 300 dpi, namely, 85 micron meter left between two adjacent ones of the printing electrodes 13. Each of the printing electrodes 13 has a main electrode portion 13*a* formed on the base film 12 and a protruding electrode portion 13*b* which protrudes from the base film 12. The protruding electrode portion 13*b* has a length of about 80 to 100 micronmeter. Each of the printing electrodes 13 has an insulating coating film 13*c* which coat surfaces of the printing electrodes 13. The insulating coating film 13*c* has a homogeneous thickness of 10 micron meter or less. Each of the printing electrodes 13 has a shape of a tape type. Particularly, each of the printing electrodes 13 is formed by a tape automated bonding (TAB) tape which is made by tape automated bonding (TAB). The insulating coating film 13*c* is formed by means of chemical vapor deposition (CVD) method which uses parylene resin.

The covering member 2 is made of insulating material and covers the main electrode portions 13*a* of the printing electrodes 13. The covering member 2 has an internal surface defining, in cooperation with the main electrode portions and the base film, the ink receiving space 3 which receives ink 14 containing coloring thermoplastic particles, namely, toner particles. The covering member 2 has the ink supply port and the ink exhaust port (not shown). The ink 14 is filled in the ink receiving space 3 through the ink supply port 10. The covering member 2 forms an ink ejecting nozzle 15 of a slit type in cooperation with the base film 12 and the printing electrodes 13. The ink meniscus 16 is formed in the vicinity of the ink ejecting nozzle 15. The ink supply port 10 is connected to an ink tank (not shown) through a tube. The ink 14 in the ink receiving space 3 is supplied with a negative pressure of about 1 $cmH_2O$ and is circulated under pressure. The ink 14 consists of petroleum organic solvent (such as isoparaffin), the toner particles, and charge controlling material which are dispersed in the petroleum organic solvent. The toner particles has an electric charge of positive polarity due to zeta potential.

Figure 7:
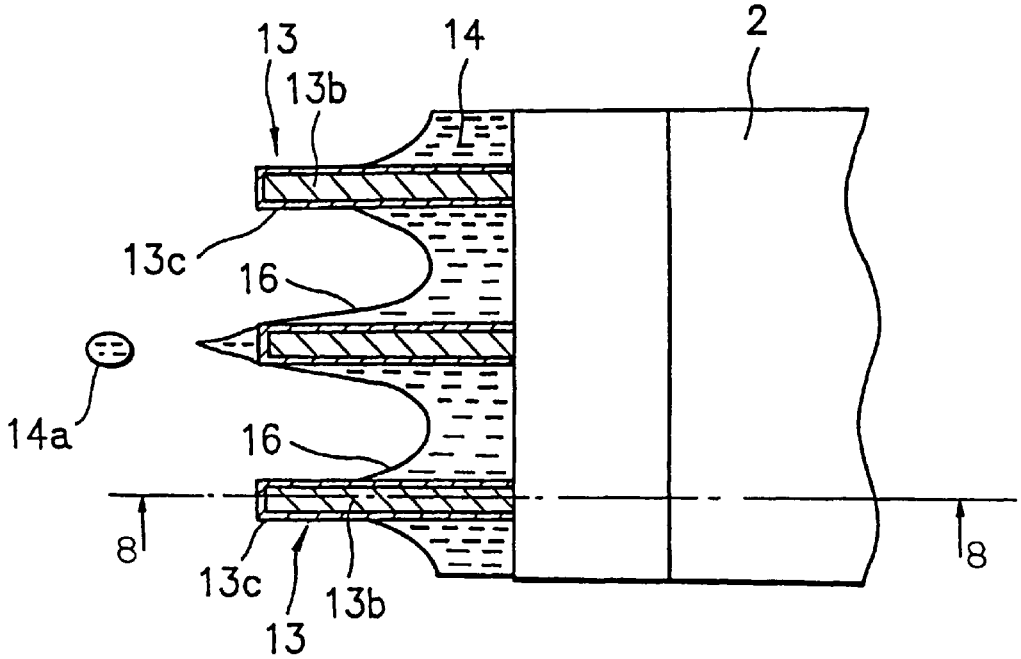
FIG. 7 is a schematic plan view of the electrostatic ink jet printing head illustrated in FIG. 6.
Figure 8:
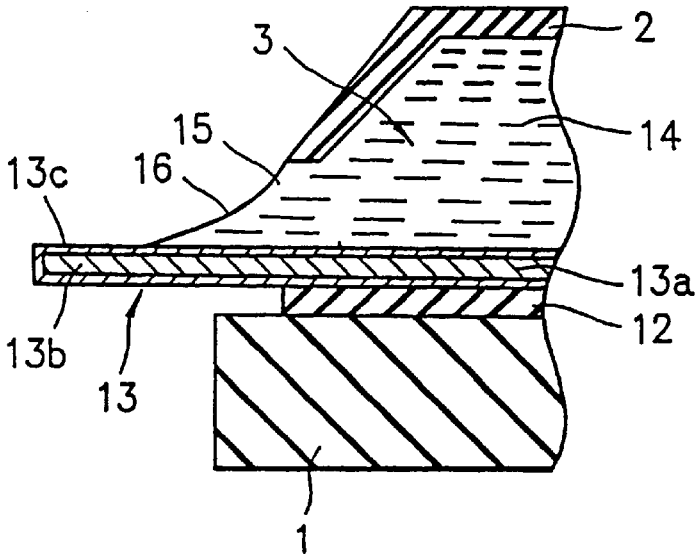
FIG. 8 is a section view taken along a line B—B in FIG. 7.

In FIGS. 7 and 8, the ink 14, by a surface tension, forms the ink meniscus 16 in the vicinity of the ink ejecting nozzle 15. Since the ink 14 in the ink receiving space 3 is supplied with a negative pressure, and since the printing electrodes 13 have the protruding electrode portions 13*b* which protrude from the base film 12 and the covering member 2, the ink meniscus 16 has a concave shape which faces below and obliquely in case of viewing the ink meniscus 16 from the side. In addition, since each of the printing electrodes 13 has a protruding electrode portion 13 which protrudes from the ink ejecting nozzle 15, the ink meniscus 16 corresponds the printing electrodes 13. Therefore, when an optional one of the printing electrodes 13 is supplied with the printing pulse voltage, the electric field is concentrated at an end of the ink meniscus 16 which is formed in the protruding electrode portion 13*b* of the printing electrode 13. As a result, the toner particles charged in the ink 14 are, by the electric field, strained from the end of the ink meniscus 16 that is protruded to fly, as an agglomeration of the toner particles, in a direction of the counter electrode (not shown), namely, the recording paper. Next, the agglomeration of the toner particles is, as a printing dot, adhered onto the recording paper and is heated to be fixed.

Figure 9:
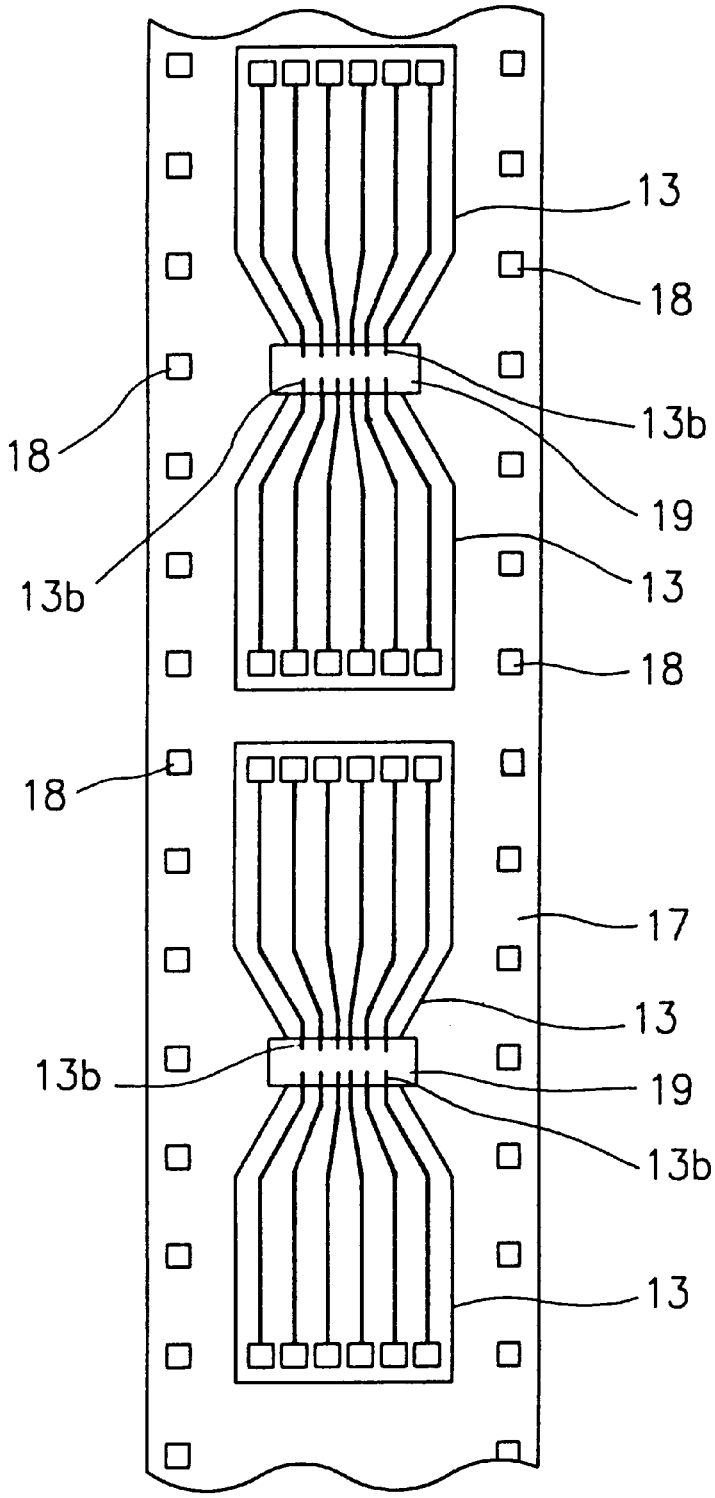
FIG. 9 is a schematic plan view for use in describing a method of manufacturing printing electrodes of the electrostatic ink jet printing head illustrated in FIG. 6.

Referring to FIG. 9, the description will proceed to a method of making the printing electrodes that uses the TAB tape. A film 17 of the TAB is prepared. The film 17 is made of, for example, polyimide and has sprocket holes 18 at both ends. Next, flash metal plating is formed on the film 17. Next, a dry film is laminated on the film 17. Next, a pattern is formed by exposing and developing the dry film. Next, metal plating of, for example, such as copper is formed on the pattern. Through holes 19 are formed by etching the film 17. Next, a resist film is taken away from the film 17 and a finished metal plating is formed on the film 17. Next, an insulating coating film is, by the CVD method, formed on a necessary portion of the film 17. The protruding electrode portions 13*b* of the printing electrodes 13 are formed in the through holes 19.

Figure 10:
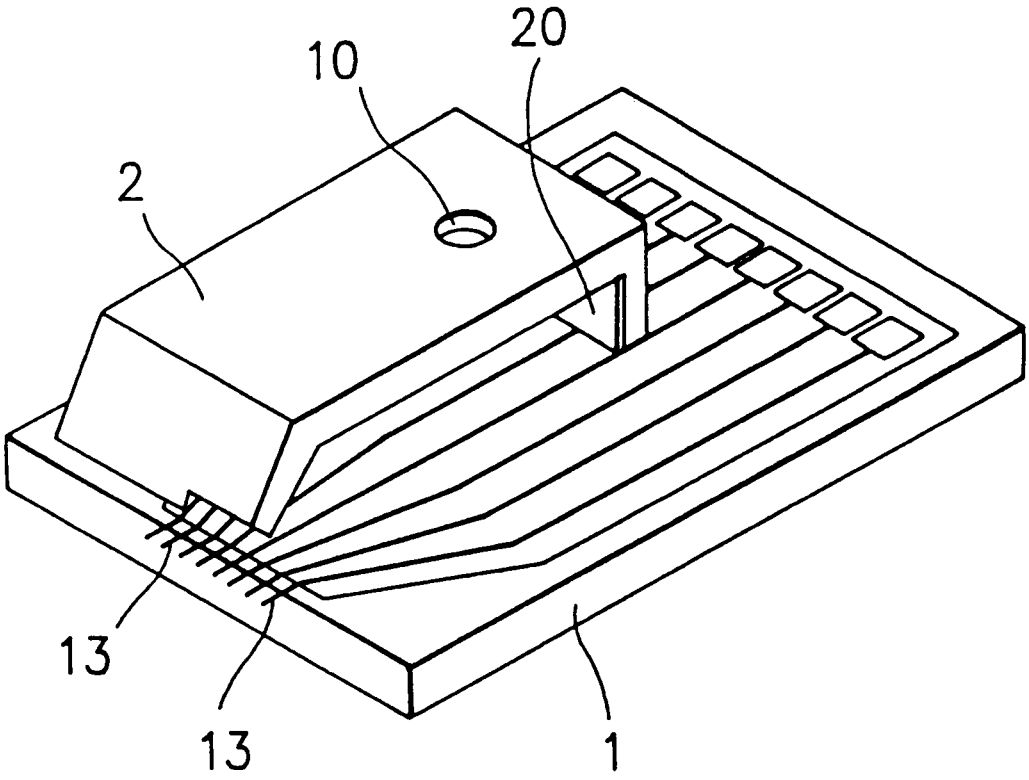
FIG. 10 is a schematic perspective view of an electrostatic ink jet printing head according to the second embodiment of this invention.

Referring to FIG. 10, the description will proceed to an electrostatic ink jet printing head according to a second embodiment of this invention. Similar parts are designated by like reference numerals.

The electrostatic ink jet printing head further 10 comprises a migration electrode 20. The migration electrode 20 is positioned in the ink receiving space 3 so that the migration electrode 20 is in contact with the ink 14. The migration electrode 20 is supplied with a migration control voltage which has the same polarity as an electric potential of the toner particles. The migration electrode 20, due to electric migration phenomena, migrates the toner particles in the ink 14 to the vicinity of the protruding electrode portions 13*b* of the printing electrodes 13.

Figure 11:
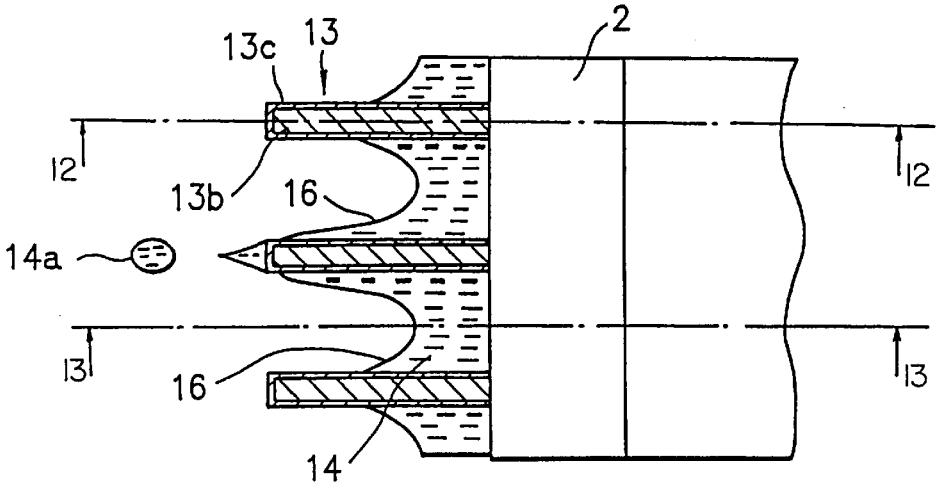
FIG. 11 is a schematic plan view of the electrostatic ink jet printing head illustrated in FIG. 10.
Figure 12:
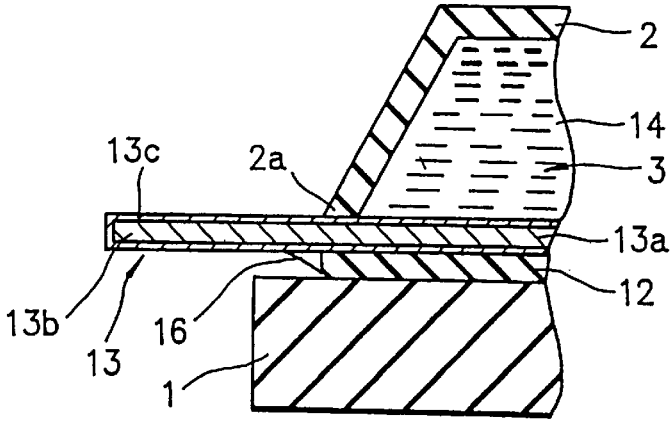
FIG. 12 is a section view taken along a line C—C in FIG. 1 1.
Figure 13:
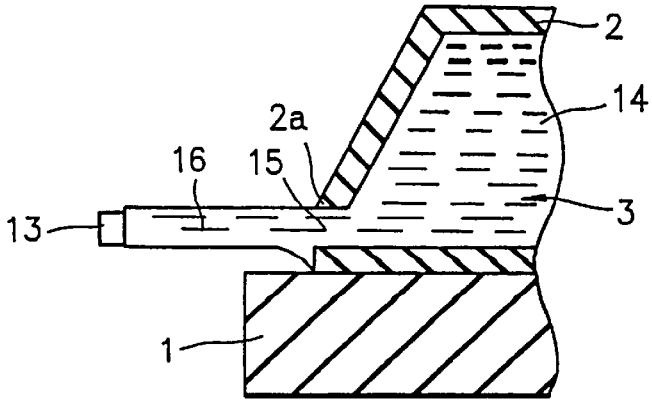
FIG. 13 is a section view taken along a line D—D in FIG. 11.
Figure 14:
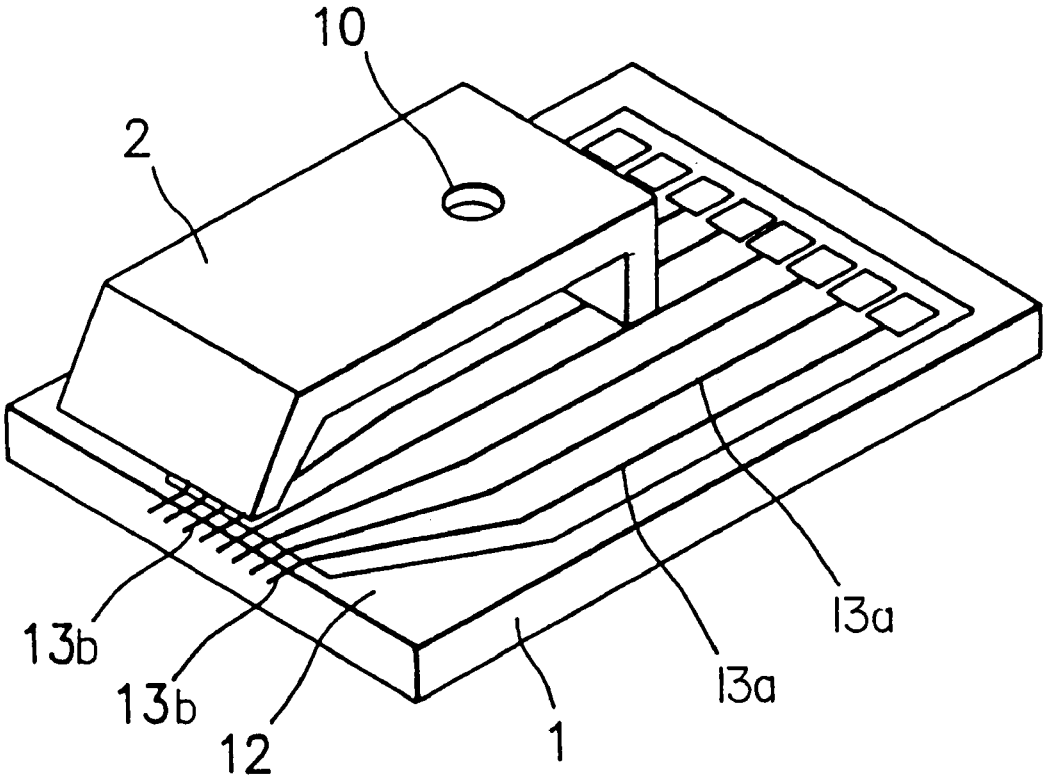
FIG. 14 is a schematic perspective view of an 30 electrostatic ink jet printing head according to the third embodiment of this invention.
Figure 15:
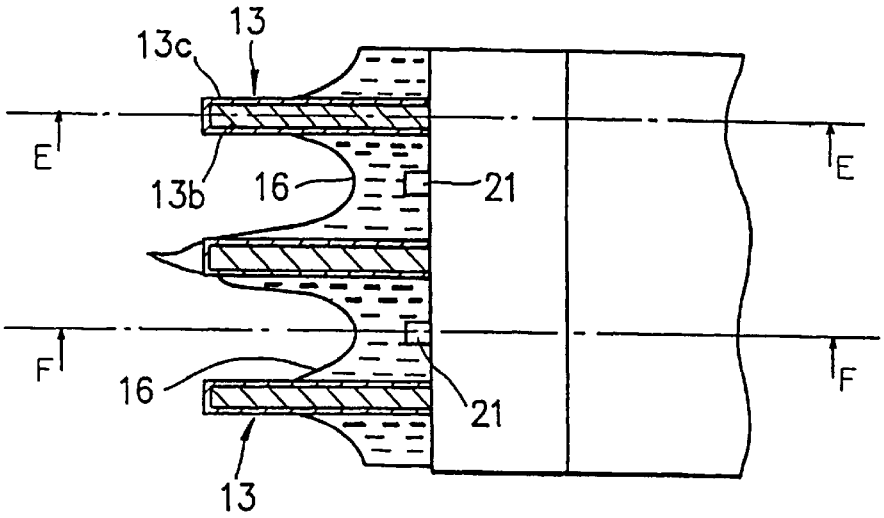
FIG. 15 is a schematic plan view of the electrostatic ink jet printing head illustrated in FIG. 14.
Figure 16:
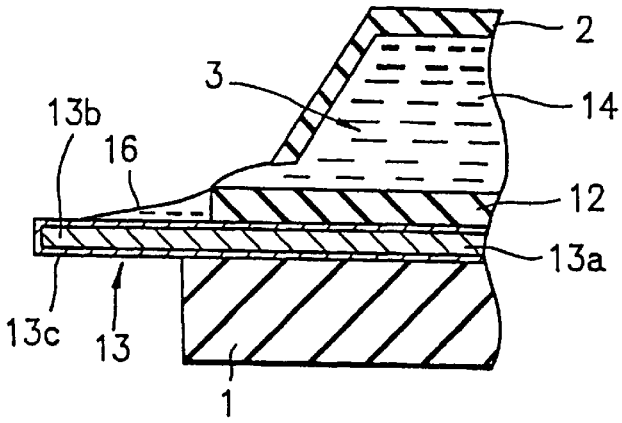
FIG. 16 is a section view taken along a line E—E in 5 FIG. 15.
Figure 17:
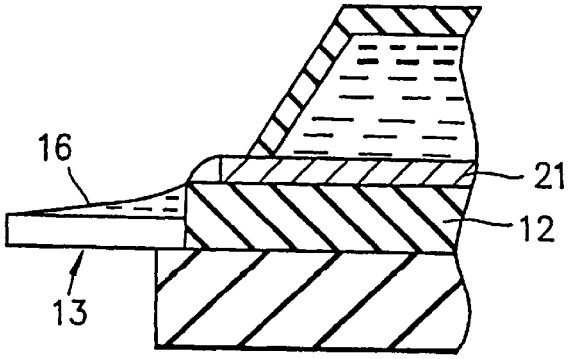
FIG. 17 is a section view taken along a line F—F in FIG. 15.

Referring to FIGS. 11, 12, and 13, the description will proceed to an electrostatic ink jet printing head according to the third embodiment of this invention. Similar parts are designated by like reference numerals. The electrostatic ink jet printing head comprises the covering member 2 having a front end 2*a* which is in contact with the printing electrodes 13. In this case, spaces among the printing electrodes 13 and the front end 2*a* of the covering member 2 forms passages which pass the ink 14. The electrostatic ink jet printing head may comprise the migration electrode 20.

Referring to FIGS. 14, 15, 16, and 17, the description will proceed to an electrostatic ink jet printing head according to the fourth embodiment of this invention. Similar parts are designated by like reference nurmerals.

The electrostatic ink jet printing head comprises the substrate 1, the printing electrodes 13, the base film 12, passage control electrodes 21, and the covering member 2.

The printing electrodes 13 are formed on the principal surface with a predetermined space left between two adjacent ones of the printing electrodes 13. The base film 12 overlays the main electrode portions 13*a* of the printing electrodes 13 and the principal surface. The passage control electrodes 21 are formed on the base film 12 with a predetermined space left between two adjacent ones of the passage control electrodes 21. Each of the passage control electrodes 21 is positioned between adjacent ones of the printing electrodes 13. The passage control electrodes 21 are formed by a method which is similar to the method of forming the printing electrodes 13. Each of the passage control electrodes 21 has a thickness of 20 to 30 micron meter. The passage control electrodes 21 are positioned apart with a space of 300 dpi, namely, about 85 micron meter left between two adjacent ones of the passage control electrodes 21. The covering member 2 covers the passage control electrodes 21. The covering member has the internal surface defining, in cooperation with the passage control electrodes and the base film 12, the ink receiving space 3 which receives the ink 14 containing toner particles.

The passage control electrodes 21 are supplied with passage control pulse voltages when the printing electrodes 13 are selectively supplied with the printing pulse voltages.

Each of the passage control pulse voltages has the same polarlity as the printing pulse voltage and a level lower than a printing level of the printing pulse voltage. Also, each of the passage control pulse voltages may have a different polarlity from the printing pulse voltage. When the passage control electrodes 21 are supplied with passage control pulse voltages, passage control electric fields are caused in vicinities of the passage control electrodes 21. The passage control electric fields prevent the toner particulates in the vicinities of the passage control electrodes 21 from moving to the printing electrodes 13. In addition, the electrostatic ink jet printing head may comprise the migration electrode 20. Also, the electrostatic ink jet printing head may comprise the covering member 2 having the front end 2*a* which is contact with the passage control electrodes 21.

Referring to FIGS. 18, 19, 20, and 21, the description will proceed to an electrostatic ink jet printing head according to the fifth embodiment of this invention. Similar parts are designated by like reference numerals.

Figure 18:
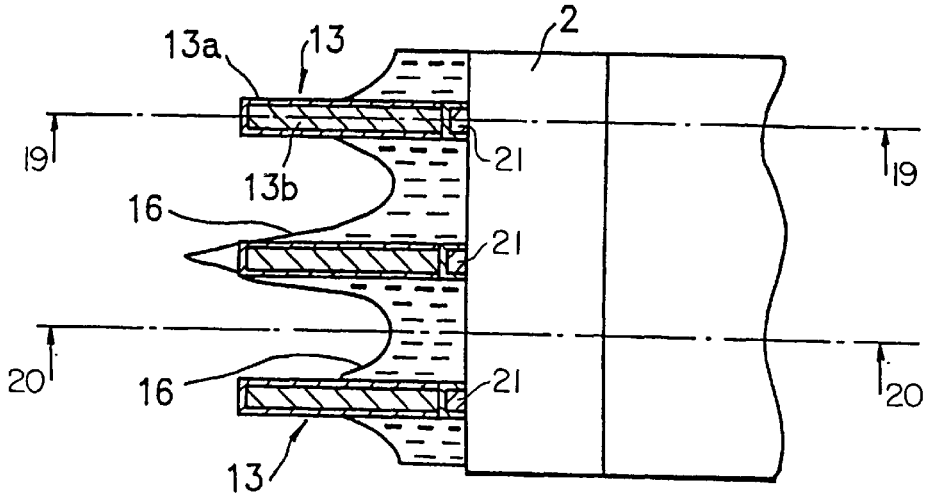
FIG. 18 is a schematic plan view of the electrostatic ink jet printing head according to a fourth embodiment of this invention.
Figure 19:
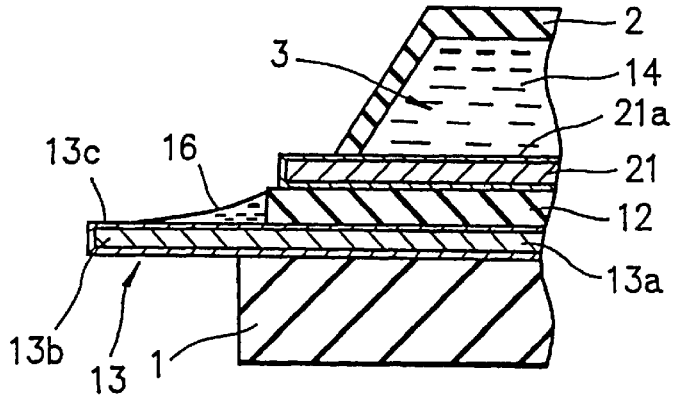
FIG. 19 is a section view taken along a line G—G in FIG. 18.
Figure 20:
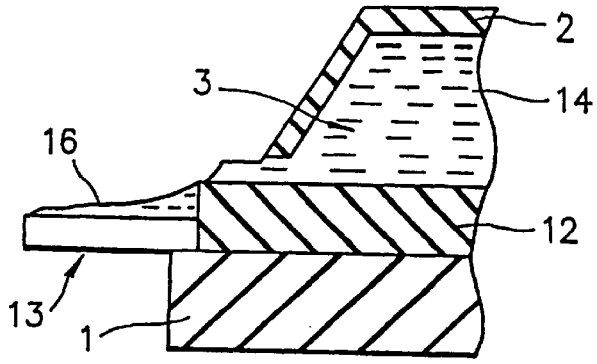
FIG. 20 is a section view taken along a line H—H in FIG. 18.

In FIGS. 18, 19, and 20, the electrostatic ink jet printing head comprises a substrate 1, printing electrodes 13, a base film 12, passage control electrodes 21, and a covering member 2. The passage control electrodes 21 are formed on the base film 12 with a predetermined space left between two adjacent ones of the passage control electrodes 21 so that each of the passage control electrodes 21 is positioned right above one of the printing electrodes 13. Each of the passage control electrodes 21 has a insulating coating film 21 a which coats the passage control electrodes 21.

Figure 21A:
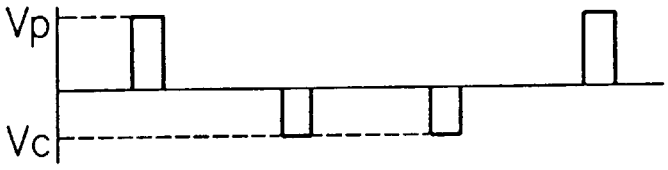
FIGS. 21A. 21B and 21C are waveform graphs for use in describing an operate of the electrostatic ink jet printing head illustrated in FIG. 18.
Figure 21B:
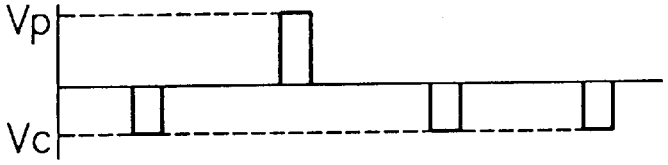
Figure 21C:
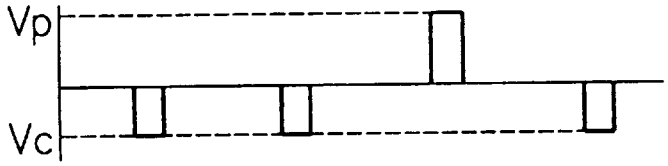

When one of the printing electrodes 13 is supplied with printing pulse voltage Vp as shown in FIG. 21A, ones of the passage control electrodes 21 except one of the passage control electrodes 21 that is positioned right above the one of the printing electrodes 13 are supplied with the passage control pulse voltages Vc as shown in FIGS. 21B and 21C. Likewise, when one of the printing electrodes 13 is supplied with printing pulse voltage Vp as shown in FIG. 21B, ones of the passage control electrodes 21 except one of the passage control electrodes 21 that is positioned right above the one of the printing electrodes 13 are supplied with the passage control pulse voltages Vc as shown in FIGS. 21A and 21C. Also, when one of the printing electrodes 13 is supplied with printing pulse voltage Vp as shown in FIG. 21 C, ones of the passage control electrodes 21 except one of the passage control electrodes 21 that is positioned right above the one of the printing electrodes 13 are supplied with the passage control pulse voltages Vc as shown in FIGS. 21A and 21B.

Each of the passage control pulse voltages has the different polarlity from the printing pulse voltage. Also, each of the passage control pulse voltages may have the same polarlity as the printing pulse voltage and a low level lower than a printing level of the printing pulse voltage. When the passage control electrodes 21 are supplied with the passage control pulse voltages, passage control electric fields are caused in vicinity of the passage control electrodes 21. The passage control electric fields prevent the toner particles in the vicinity of the passage control electrodes 21 from moving to the printing electrodes 13.

In addition, the electrostatic ink jet printing head may comprise the migration electrode 20. Also, the electrostatic ink jet printing head may comprise the covering member 2 having the front end 2*a* which is contact with the passage control electrodes 21.

What is claimed is:

1. An electrostatic ink jet printing head comprising:

a substrate made of electrically insulating material and having a principal surface;

a base film made of electrically insulating material and overlaying said principal surface;

a plurality of printing electrodes formed on said base film with a predetermined space left between two adjacent ones of said printing electrodes, said printing electrodes each having an electrically insulating coating film thereon, each of said printing electrodes having a main electrode portion formed on said base film and a protruding electrode portion which overhangs from said base film; and a covering member covering said main electrode portion, said covering member having an internal surface defining, in cooperation with said main electrode portions and said base film, an ink receiving space which receives ink containing toner particles.

2. An electrostatic ink jet printing head as claimed in claim 1, wherein said electrostatic ink jet printing head further comprises a migration electrode which is positioned in said ink receiving space so that said migration electrode is in contact with said ink.

3. An electrostatic ink jet printing head as claimed in claim 2, wherein said covering member has a front end which is in contact with said printing electrodes.

4. An electrostatic ink jet printing head as claimed in claim 1, wherein said covering member has a front end which is in contact with said printing electrodes.

5. An electrostatic ink jet printing head comprising:

a substrate made of electrically insulating material and having a principal surface;

a plurality of printing electrodes formed on said principal surface with a predetermined space left between two adjacent ones of said printing electrodes, said printing electrodes each having an electrically insulating coating film thereon, each of said printing electrodes having a main electrode portion formed on said principal surface and a protruding electrode portion which overhangs from said substrate;

a base film made of electrically insulating material and overlaying said main electrode portions of said printing electrodes and said principal surface;

a plurality of passage control electrodes formed on said base film with a predetermined space left between two adjacent ones of said passage control electrodes so that each of said passage control electrodes is positioned between two adjacent ones of said printing electrodes, and a covering member covering said passage control electrodes, said covering member having an internal surface defining, in cooperation with said passage control electrodes and said base film, an ink receiving space which receives ink containing toner particles.

6. An electrostatic ink jet printing head as claimed in claim 5, wherein said electrostatic ink jet printing head further comprises a migration electrode which is positioned in said ink receiving space so that said migration electrode is in contact with said ink.

7. An electrostatic ink jet printing head as claimed in claim 6, further comprising means for supplying said passage control electrodes with passage control pulse voltages when said printing electrodes are selectively supplied with printing pulse voltages, each of said passage control pulse voltages having the same polarity as said printing pulse voltages and a level lower than a printing level of said printing pulse voltage.

8. An electrostatic ink jet printing head as claimed in claim 6, further comprising means for supplying said passage control electrodes with passage control pulse voltages when said printing electrodes are supplied with printing pulse voltages, each of said passage control pulse voltages having a different polarity from said printing pulse voltage.

9. An electrostatic ink jet printing head as claimed in claim 5, further comprising means for supplying said passage control electrodes with passage control pulse voltages when said printing electrodes are selectively supplied with printing pulse voltages, each of said passage control pulse voltages having the same polarity as said printing pulse voltages and a level lower than a printing level of said printing pulse voltage.

10. An electrostatic ink jet printing head as claimed in claim 5, further comprising means for supplying said passage control electrodes with passage control pulse voltages when said printing electrodes are supplied with printing pulse voltages, each of said passage control pulse voltages having a different polarity from said printing pulse voltage.

11. An electrostatic ink jet printing head as claimed in claim 5, wherein said substrate includes a distal end which extends distally of said ink receiving space, and each of said protruding electrode portions extends distally of said substrate distal end.

12. An electrostatic ink jet printing head as claimed in claim 11, wherein each of said plurality of printing electrodes extends distally of each of said plurality of passage control electrodes.

13. An electrostatic ink jet printing head as claimed in claim 11, wherein said covering member is located over each of said plurality of passage control electrodes so that each of said plurality of passage control electrodes extends beyond said covering member but does not overhang said substrate or said base film.

14. An electrostatic ink jet printing head as claimed in claim 5, wherein said base film is located over said substrate so that said substrate extends beyond said base film.

15. An electrostatic ink jet printing head as claimed in claim 5, wherein said passage control electrodes are parallel to said printing electrodes.

16. An electrostatic ink jet printing head comprising;

a substrate made of electrically insulating material and having a principal surface;

a plurality of printing electrodes formed on said principal surface with a predetermined space left between two adjacent ones of said printing electrodes, said printing electrodes each having an electrically insulating coating film thereon, each of said printing electrodes having a main electrode portion formed on said principal surface and a protruding electrode portion which overhangs from said substrate;

a base film made of electrically insulating material and overlaying said main electrode portions of said printing electrodes and said principal surface;

a plurality of passage control electrodes formed on said base film with a predetermined space left between two adjacent ones of said passage control electrodes so that each of said passage control electrodes is positioned right above one of said printing electrodes; and a covering member covering said passage control electrodes, said covering member having an internal surface defining, in cooperation with said passage control electrodes and said base film, an ink receiving space which receives ink containing toner particles.

17. An electrostatic ink jet printing head as claimed in claim 16, wherein said electrostatic ink jet printing head further comprises a migration electrode which is positioned in said ink receiving space so that said migration electrode is in contact with said ink.

18. An electrostatic ink jet printing head as claimed in claim 17, further comprising means for supplying selected ones of said passage control electrodes with passage control pulse voltages when one of said printing electrodes is supplied with a printing pulse voltage, the selected ones of said passage control electrodes being said passage control electrodes except one of said passage control electrodes that is positioned right above the one of said printing electrodes that is supplied with said printing pulse voltage, each of said passage control pulse voltages having the same polarity as said printing pulse voltages and a level lower than a printing level of said printing pulse voltage.

19. An electrostatic ink jet printing head as claimed in claim 17, further comprising means for supplying selected ones of said passage control electrodes with passage control pulse voltages when one of said printing electrodes is supplied with printing pulse voltage, the selected ones of said passage control electrodes being said passage control electrodes except one of said passage control electrodes that is positioned right above the one of said printing electrodes that is supplied with said printing pulse voltage, each of said passage control pulse voltages has a different polarity from said printing pulse voltage.

20. An electrostatic ink jet printing head as claimed in claim 16, further comprising means for supplying selected ones of said passage control electrodes with passage control pulse voltages when one of said printing electrodes is supplied with a printing pulse voltage, the selected ones of said passage control electrodes being said passage control electrodes except one of said passage control electrodes that is positioned right above the one of said printing electrodes that is supplied with said printing pulse voltage, each of said passage control pulse voltages having the same polarity as said printing pulse voltages and a level lower than a printing level of said printing pulse voltage.

21. An electrostatic ink jet printing head as claimed in claim 16, further comprising means for supplying selected ones of said passage control electrodes with passage control pulse voltages when one of said printing electrodes is supplied with printing pulse voltage, the selected ones of said passage control electrodes being said passage control electrodes except one of said passage control electrodes that is positioned right above the one of said printing electrodes that is supplied with said printing pulse voltage, each of said passage control pulse voltages has a different polarity from said printing pulse voltage.

22. An electrostatic ink jet printing head as claimed in claim 16, wherein said substrate includes a distal end which extends distally of said ink receiving space, and each of said protruding electrode portions extends distally of said substrate distal end.

23. An electrostatic ink jet printing head as claimed in claim 22, wherein each of said plurality of printing electrodes extends distally of each of said plurality of passage control electrodes.

24. An electrostatic ink jet printing head as claimed in claim 22, wherein said covering member is located over each of said plurality of passage control electrodes so that each of said plurality of passage control electrodes extends beyond said covering member but does not overhang said substrate or said base film.

25. An electrostatic ink jet printing head as claimed in claim 16, wherein said base film is located over said substrate so that said substrate extends beyond said base film.

26. An electrostatic ink jet printing head as claimed in claim 16, wherein said passage control electrodes are parallel to said printing electrodes.

27. An electrostatic ink jet a substrate made of electrically insulating material and having a principal surface;

a plurality of printing electrodes formed over said substrate with a predetermined space left between two adjacent ones of said printing electrodes, said printing electrodes each having a main electrode portion formed over said substrate and a protruding electrode portion which overhangs from said substrate;

a covering member covering said main electrode portion, said covering member having an internal surface defining, in cooperation with said main electrode portions and said substrate, an ink receiving space for receiving ink containing toner particles;

a base film made of electrically insulating material and overlaying said principal surface of said substrate, wherein said base film overlies said printing electrodes and said principal surface of said substrate; and a plurality of passage control electrodes formed on said base film with a predetermined space left between two adjacent ones of said passage control electrodes.

28. An electrostatic ink jet printing head as claimed in claim 27, wherein said base film is between said printing electrodes and said substrate.

29. An electrostatic ink jet printing head as claimed in claim 27, wherein each of said passage control electrodes is positioned between two adjacent ones of said printing electrodes.

30. An electrostatic ink jet printing head as claimed in claim 27, wherein each of said passage control electrodes is positioned right above one of said printing electrodes.

31. An electrostatic ink jet printing head as claimed in claim 20, further comprising an electrically insulating coating film formed on each of said printing electrodes.

32. An electrostatic ink jet printing head as claimed in claim 27, further comprising a migration electrode which is positioned in said ink receiving space.

33. An electrostatic ink jet printing head as claimed in claim 27, wherein said ink receiving space includes an ink jetting opening facing toward one end of said substrate, and said protruding electrode portions overhang from said one end of said substrate.

34. An electrostatic ink jet printing head as claimed in claim 27, wherein said passage control electrodes are formed in said ink receiving space.

* * * * *

UNITED STATES PATENT AND TRADEMARK OFFICE

CERTIFICATE OF CORRECTION

PATENT NO. : 6,220,696 B1
DATED : April 24, 2001
INVENTOR(S) : Junichi Suetsugu et al.

It is certified that error appears in the above-identified patent and that said Letters Patent is hereby corrected as shown below:

Column 1,
Lines 13-14, delete “negligable” and insert -- negligible --;
Line 24, delete “filed” and insert -- flied --;

Column 9,
Lines 53, 61 and 67, delete “6” and insert -- 5 --;

Column 10,
Line 8, delete “5” and insert -- 6 --;

Column 12,
Line 8, after “jet” insert -- printing head comprising: --;
Line 54, delete “27” and insert -- 29 --.

Signed and Sealed this

Twenty-eighth Day of December, 2004

JON W. DUDAS
*Director of the United States Patent and Trademark Office*